US008758175B2

(12) United States Patent
Yu

(10) Patent No.: US 8,758,175 B2
(45) Date of Patent: Jun. 24, 2014

(54) WEIGHTING DEVICE AND RACKET EQUIPPED WITH THE SAME

(75) Inventor: Kuo-Pin Yu, Taichung (TW)

(73) Assignee: Yuan Min An Enterprise Co., Ltd., Taichung (TW)

( * ) Notice: Subject to any disclaimer, the term of this patent is extended or adjusted under 35 U.S.C. 154(b) by 249 days.

(21) Appl. No.: 13/477,540

(22) Filed: May 22, 2012

(65) Prior Publication Data

US 2013/0316858 A1 Nov. 28, 2013

(51) Int. Cl.
*A63B 49/00* (2006.01)

(52) U.S. Cl.
USPC ..... 473/519; 473/539; 473/553

(58) Field of Classification Search
USPC ..... 473/519, 539, 553
See application file for complete search history.

(56) References Cited

U.S. PATENT DOCUMENTS

| | | | | | |
|---|---|---|---|---|---|
| 3,625,512 | A * | 12/1971 | Latham et al. | ..... | 473/519 |
| 3,913,911 | A * | 10/1975 | Peterson | ..... | 473/519 |
| 4,353,551 | A * | 10/1982 | Arieh et al. | ..... | 473/521 |
| 4,693,474 | A * | 9/1987 | Glaessgen et al. | ..... | 473/519 |
| 4,697,811 | A * | 10/1987 | Muroi | ..... | 473/519 |
| 4,720,105 | A * | 1/1988 | Ferrari et al. | ..... | 473/519 |
| 5,054,780 | A * | 10/1991 | Chen | ..... | 473/519 |
| 5,362,071 | A * | 11/1994 | Liu | ..... | 473/539 |
| 7,217,203 | B2 * | 5/2007 | Takeuchi et al. | ..... | 473/537 |
| 2012/0289366 | A1 * | 11/2012 | Kimmelman | ..... | 473/519 |
| 2013/0123050 | A1 * | 5/2013 | Reese et al. | ..... | 473/553 |
| 2013/0316858 | A1 * | 11/2013 | Yu | ..... | 473/519 |

FOREIGN PATENT DOCUMENTS

| | | |
|---|---|---|
| TW | 172917 | 11/1991 |
| TW | 180394 | 3/1992 |
| TW | 357624 | 5/1999 |
| TW | 201138899 | 11/2011 |

* cited by examiner

*Primary Examiner* — Raleigh W Chiu
(74) *Attorney, Agent, or Firm* — Muncy, Geissler, Olds & Lowe, P.C.

(57) ABSTRACT

A weighting device for use with a racket includes at least one frame strip, at least one weight, and at least one screw. The frame strip is adapted for being mounted on an outer circumference of a racket frame and has a dovetail groove extending along a longitudinal direction thereof, and a plurality of through holes provided at a bottom wall of the dovetail groove. The weight has a threaded through hole and is slidably engaged in the dovetail groove. The screw is threadedly engaged with the threaded through hole of the weight and provided with an end stoppable against the bottom wall of the dovetail groove for holding the weight stationarily. Therefore, the weight can be firmly positioned and the balance of a racket using the weighting device can be quickly adjusted by adjusting the position of the weight.

18 Claims, 6 Drawing Sheets

WEIGHTING DEVICE AND RACKET EQUIPPED WITH THE SAME

BACKGROUND OF THE INVENTION

1. Field of the Invention

The present invention relates generally to weighting devices for use with sports equipments and more particularly, to a weighting device and a racket using the same, which has at least one weight that can be quickly adjusted in its position.

2. Description of the Related Art

Many sports games, such as tennis sport, badminton sport and squash sport, are playing by hitting a ball with a racket. The weight and balance of the racket will directly affect the swing weight and the moment of inertia, so that they will greatly influence the control ability and the ball-hitting effect of the racket.

Every user may have a different requirement about the balance of the racket. Even a same user may have a need to quickly adjust the balance of the racket subject to his/her game plan and physical condition. Therefore, many kinds of balance adjustable rackets are commercially available in the market.

In the conventional balance adjustable rackets, many of them, such as the rackets disclosed in Taiwan Patent No. 172917 entitled "Improved Protective Guard for Racket" and Taiwan Patent No. 180394 entitled "Protective Guard Structure Capable of Adjusting Balance of Racket", used weights that are directly embedded in the wings of the protective guard to achieve the purpose of adjusting the balance of the racket. However, in the aforesaid Taiwan patents, the assembling and dismantling process of the weights is somewhat complicated, so that the user's need of quickly adjusting the balance of the racket may not be fulfilled.

Taiwan Patent Publication No. 201138899 disclosed a racket, which includes a circumferential frame sleeve with a plurality of threaded tubular portions for being threadedly engaged with screws served as weights. By this design, the balance of the racket may be quickly adjusted; however, it needs to preset a plurality of the threaded tubular portions in the circumferential frame sleeve. This may complicate the manufacturing process of the racket and increase the manufacturing cost.

Taiwan Patent No. 357624 entitled "Tennis Racket Structure Capable of Quickly and Slightly Adjusting Its Balance" disclosed a balance adjustable racket. In this patent, a moveable seat of a balance adjusting apparatus is slidably coupled to a main body of the apparatus, such that the balance of the racket can be quickly adjusted by sliding the moveable seat along the main body. The moveable seat is positioned and held stationarily to the main body by a male and female coupling mechanism and a spring sheet set between the moveable seat and the main body. The positioning effect of the moveable seat tends to be deteriorated due to elasticity fatigue or wear of the spring sheet. In addition, the moveable seat tends to escape from its desired stationary position due to the centrifugal force as the racket is swung. Therefore, the aforesaid design may not completely meet the user's requirement.

SUMMARY OF THE INVENTION

The present invention has been accomplished in view of the above-noted circumstances. It is therefore a primary objective of the present invention to provide a weighting device having a weight, a position of which can be quickly adjusted.

Another objective of the present invention is to provide a weighting device having a weight, which can be firmly held in position.

To achieve the above-mentioned objectives, a weighting device for use with a racket having a frame with string holes comprises at least one frame strip, at least one weight, and at least one screw corresponding in number to the weight. The frame strip is adapted for being mounted on an outer circumference of the frame of the racket and provided with a dovetail groove extending along a longitudinal direction thereof, and a plurality of through holes provided at a bottom wall of the dovetail groove and adapted for being aligned with the string holes of the frame of the racket respectively. The weight is provided with a threaded through hole and slidably engaged in the dovetail groove of the frame strip. The screw is threadedly engaged with the threaded through hole of the weight and has an end stoppable at the bottom wall of the dovetail groove of the frame strip for holding the weight in the frame strip stationarily.

Still another objective of the present invention is to provide a racket equipped with the above-mentioned weighting device. To achieve this objective, the racket comprises a handle, a frame having string holes, a bridge connected between the frame and the handle, and the above-mentioned weighting device having the aforesaid frame strip mounted on an outer circumference of the frame.

Since the weight is moveable along the dovetail groove, the balance of the racket can be quickly adjusted by changing the position of the weight. The weighting device has a simple structure, which can be easily manufactured.

On the other hand, the positioning of the weight is mainly achieved by urging the end of the screw against the bottom wall of the dovetail groove. When the screw is tightened up, the weight will be raised and tightly abutted against a part of the dovetail groove, such that a friction will be generated between the weight and the part of the dovetail groove in addition to the friction generated between the end of the screw and the bottom wall of the dovetail groove. This can ensure that the weight can be firmly positioned at a desired position, thereby preventing the weight from escape from the desired position as the racket is swung and prohibiting the deterioration of the positioning ability due to wear. As a result, the weighting device of the present invention is durable and reliable in positioning effect of the weight.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
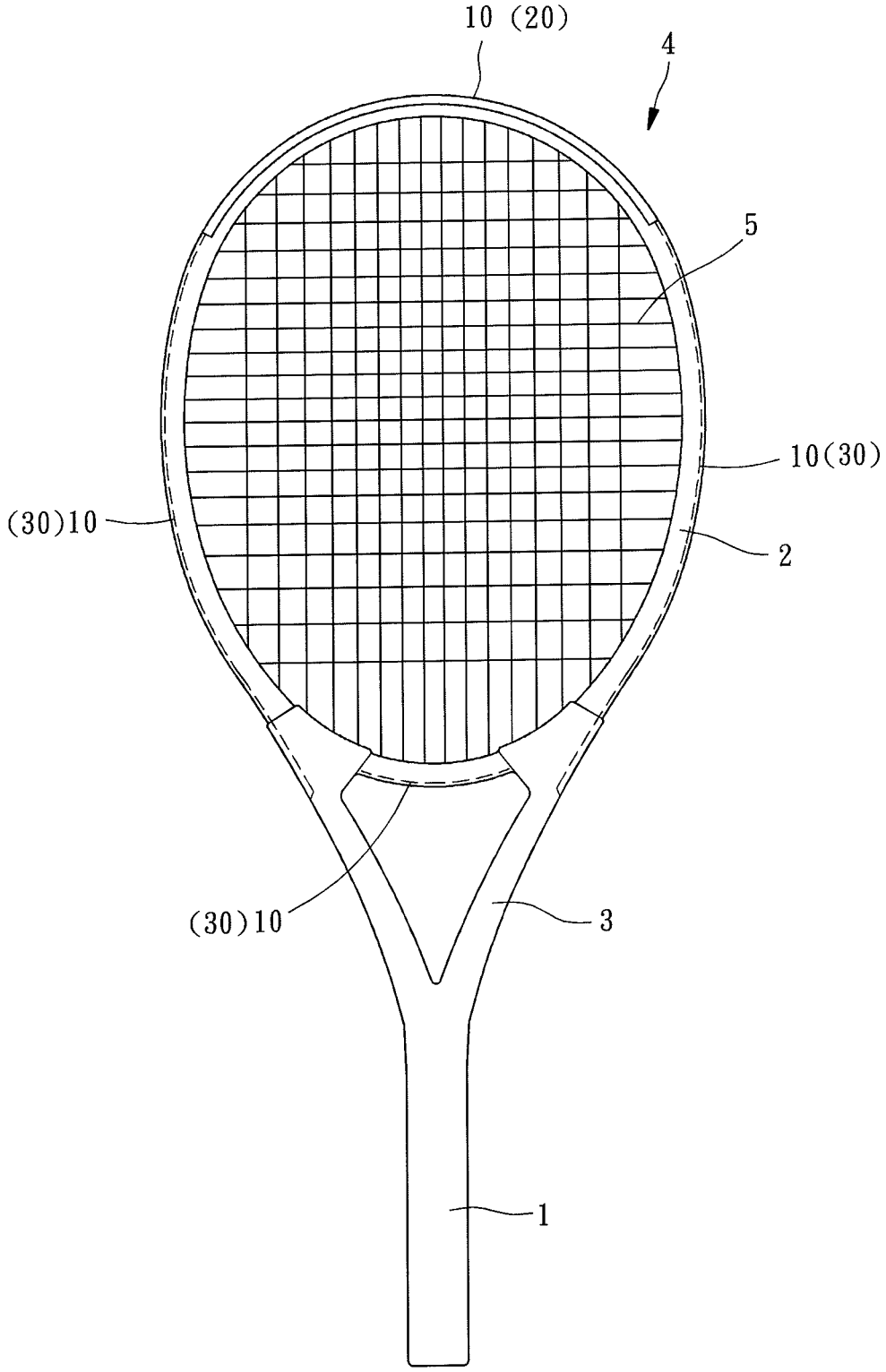
FIG. 1 is a front view of a racket according to a preferred embodiment of the present invention.
Figure 2:
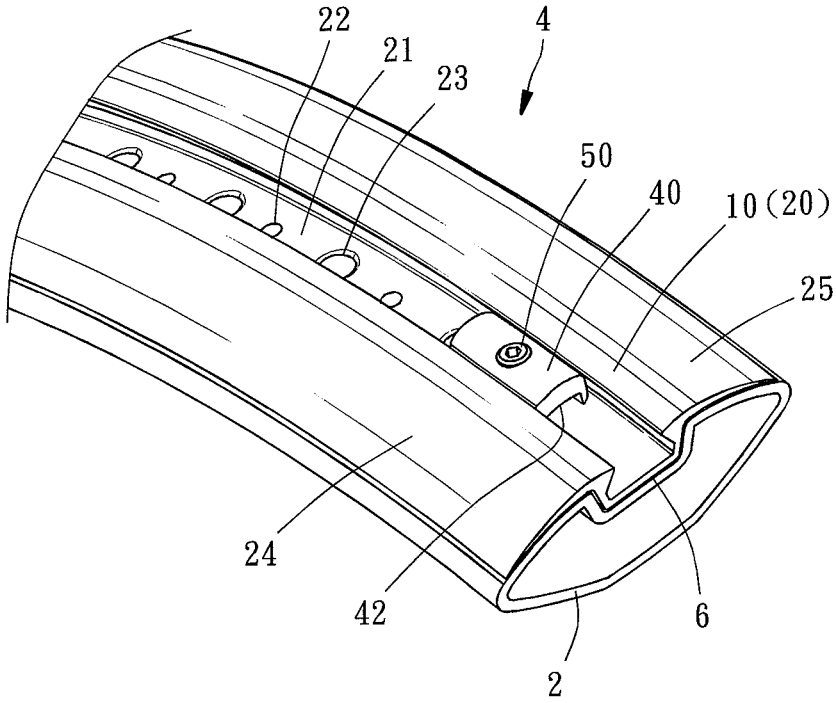
FIG. 2 is a perspective view of parts of the frame and the weighting device provided according to the preferred embodiment of the present invention, wherein the frame strip of the weighting device is realized as a protective guard.
Figure 3:
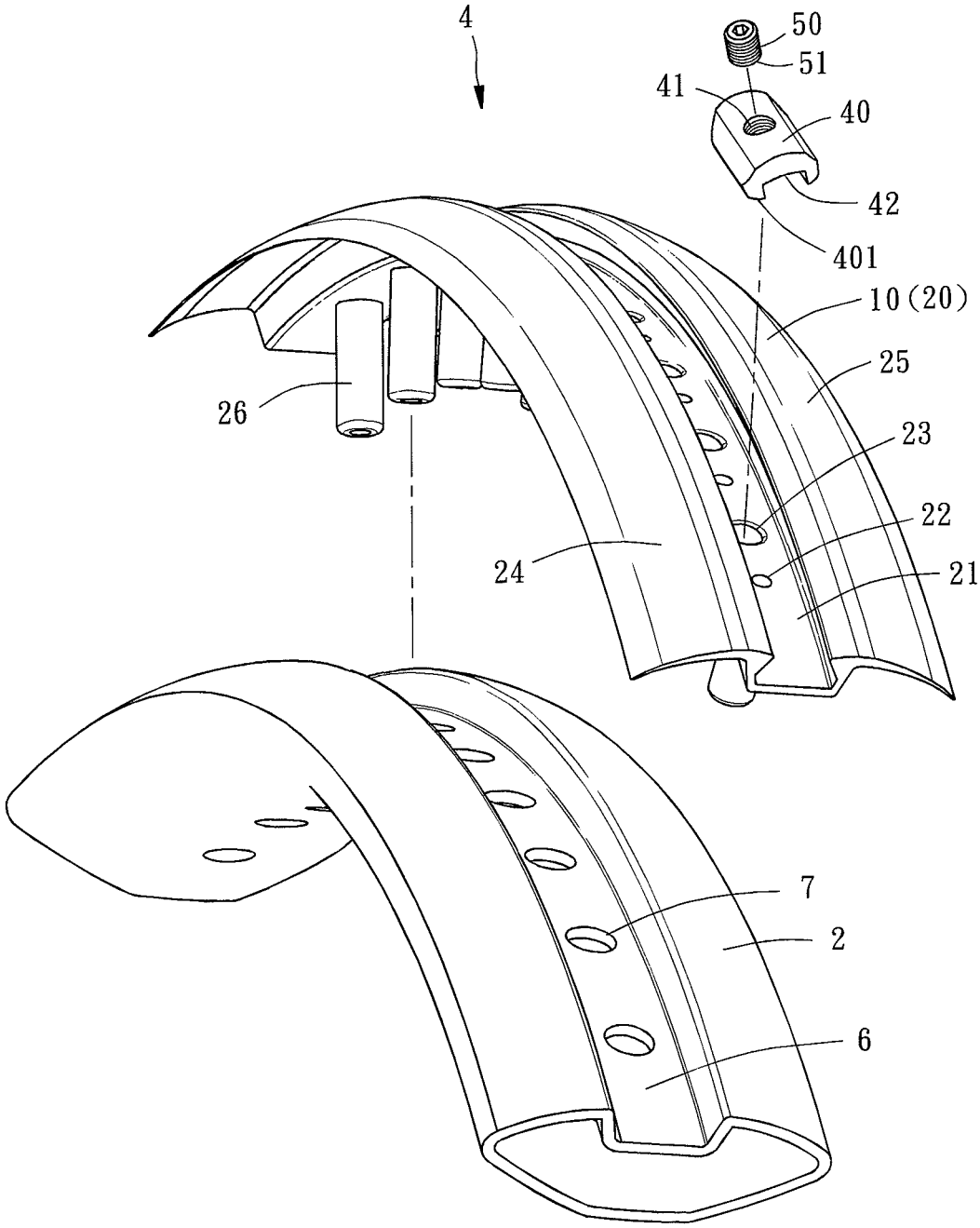
FIG. 3 is an exploded perspective view of the parts of the frame and the weighting device of FIG. 2.
Figure 4:
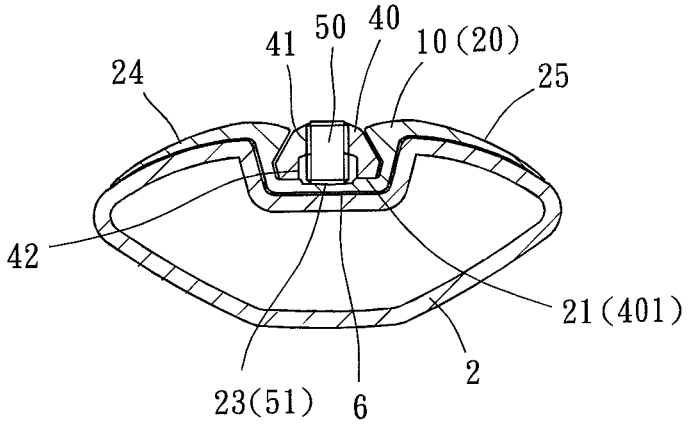
FIG. 4 is a transversely cross-sectional view of the frame and the weighting device of the preferred embodiment of the present invention, wherein the frame strip of the weighting device is realized as a protective guard.

FIG. 1 shows a racket of the present invention, which comprises a handle 1, a frame 2, a bridge 3 connected between the handle 1 and the frame 2, and a weighting device 4. In this preferred embodiment, the racket is realized as a tennis racket having a fork-shaped bridge 3 capable of bearing a great ball-hitting reaction force. However, it will be appreciated that the essential technical features of the present invention can be applied to any suitable rackets, such as a badminton racket having a linear bridge connected between the frame and the handle thereof. In addition, the weighting device 4 is mounted to an outer circumference of the frame 2; however, the weighting device 4 can extend to the outer periphery of the bridge 3. As to the detailed structure of the weighting device 4, it will be described hereinafter. In this embodiment, the racket includes a net-shaped ball-hitting surface formed of string 5 stretched with a certain tension. Since the tension, which is usually expressed by a unit of pound, is commonly set according to the user's need, most of the rackets sold in the market are not provided with the string made ball-hitting surface. Under this circumstance, it'll be appreciated that the 'racket' defined in the present invention may refer to the racket with or without the preset ball-hitting surface.

FIGS. 2-5 and FIGS. 6-7 are the assembled, exploded or cross-sectional views of parts of the frame 2 and the weighting device 4. The outer circumference of the frame 2 is usually provided with a string receiving channel 6 with a plurality of string holes 7. The weighting device 4 comprises at least one frame strip 10, at least one weight 40, and at least one screw 50 corresponding in number to the weight 50. According to the function and configuration, the frame strip 10 may be classified as a so-called "protective guard" or "grommet strip". To easily distinct and describe the frame strip 10, the frame strip 10 may be called "protective guard" or "grommet strip" in the written description hereinafter. In other words, the term "protective guard" or "grommet strip" has the same meaning as the frame strip in the present invention. For example, the frame strip 10 is referred to as the protective guard 20 in FIGS. 2-5, and the grommet strip 30 in FIGS. 6-7.

As shown in FIGS. 2-5, the protective guard 20 is mounted on the outer circumference of the frame 2. The protective guard 20 is provided at two lateral sides thereof with two wings 24 and 25 for comprehensively covering the outer circumference of the frame 2 so as to achieve the purpose of completely protecting the frame 2. To protect the frame 2, the protective guard 20 is usually mounted to the place that may be constantly hit, such as a place of the frame 2 extending clockwise from the ten o'clock position to the two o'clock position viewing from FIG. 1. In addition to the wings 24 and 25, the protective guard 20 further includes a dovetail groove 21 extending along the longitudinal direction thereof, a plurality of through holes 22 at the bottom wall of the dovetail groove 21, a plurality of positioning recesses 23 on the bottom wall of the dovetail groove 21, and a plurality of double open-end tubular inserts 26 protruding from a bottom surface of the protective guard 20. The through holes 22 and the positioning recesses 23 are arranged in an alternate manner on the bottom wall of the frame strip. Each positioning recess 23 includes a main positioning surface 232 and a beveled guide surface 231 connected with a side of the main positioning surface, which is located at the longitudinal direction of the frame strip 20. Each tubular insert 26 is communicated with one of the through holes 22 and inserted into one of the string holes 7 of the frame 2, such that each through hole 22 is in alignment with one of the string holes 7 of the frame 2 for insertion of the string 5 therethrough. At least a part of the protective guard 20, e.g. the periphery wall of the dovetail groove 21, is received in the string receiving channel 6. In this embodiment, the tubular inserts 26 are integrally formed beneath the dovetail groove 21. However, the tubular inserts 26 can be individual members mounted beneath the dovetail groove 21.

Figure 6:
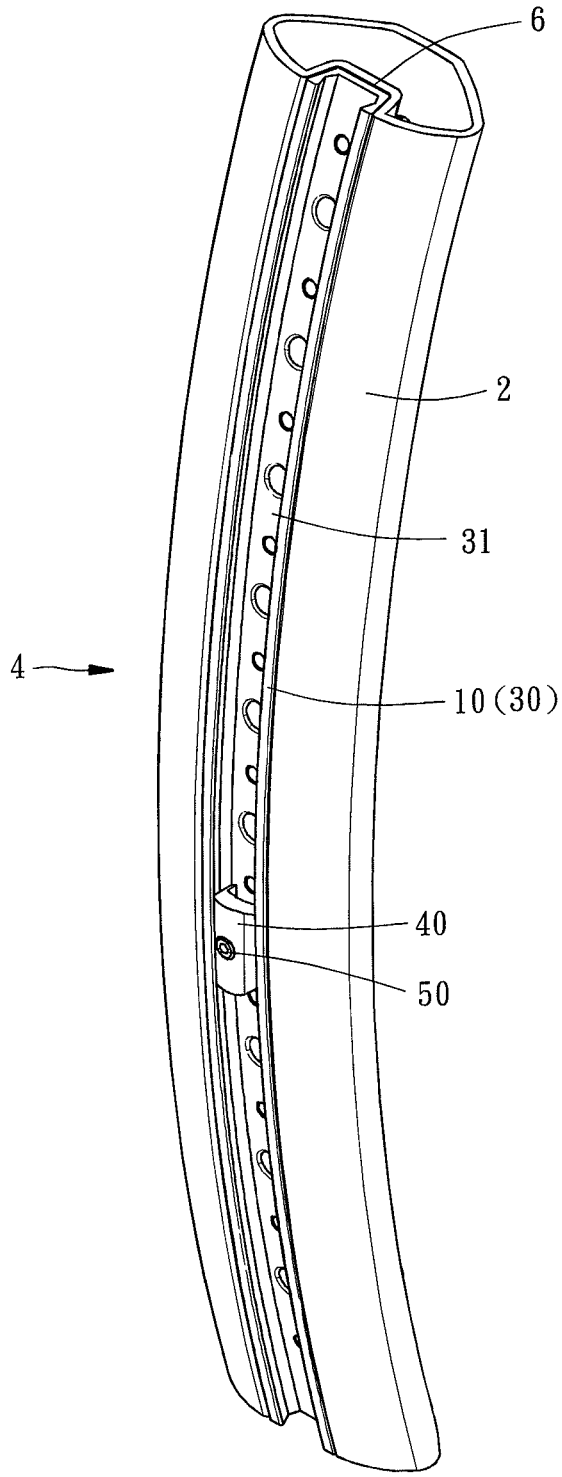
FIG. 6 is a perspective view of parts of the frame and the weighting device provided according to the preferred embodiment of the present invention, wherein the frame strip of the weighting device is realized as a grommet strip.
Figure 7:
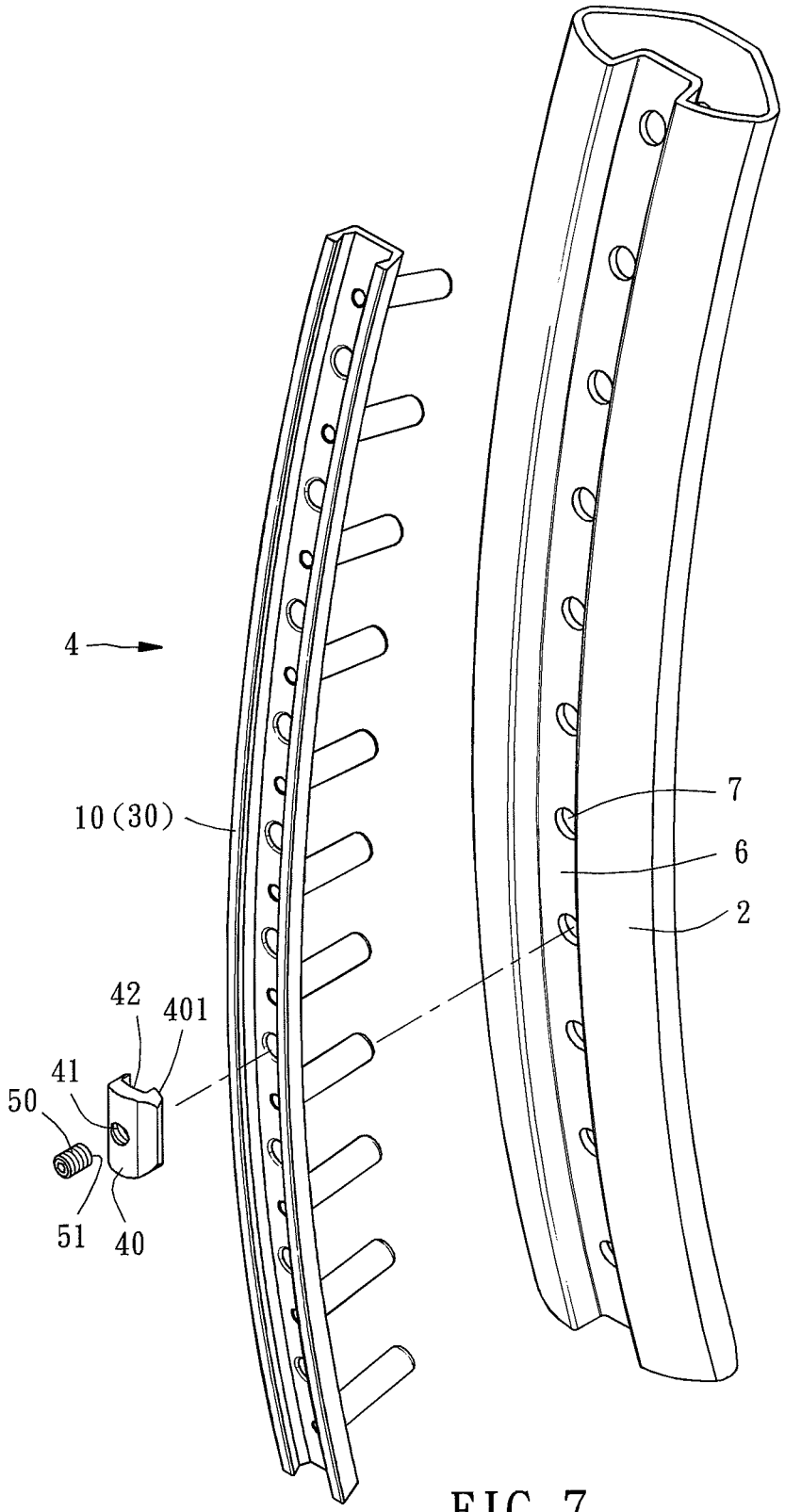
FIG. 7 is an exploded perspective view of the parts of the frame and the weighting device of FIG. 6.

As shown in FIGS. 6 and 7, the grommet strip 30 has a configuration substantially the same as that of the protective guard 20, except that the grommet strip 30 is provided with no wings 24 and 25 to have a lighter weight than the protective guard 20, and the grommet strip 30 is mounted to the place of the frame, which is occasionally hit. FIG. 1 shows that three grommet strips 30 are spacedly arranged at the place extending clockwise from the two o'clock position to the ten o'clock position of the frame 2, including the position located between the two fork arms of the bridge 3. In addition, the grommet strip 30 may be abutted with the protective guard 20, such that the dovetail groove 21 of the protective guard 20 will be in alignment and communication with the dovetail groove 31 of the grommet strip 30. Since the other parts of the grommet strip 30 are basically the same as those of the protective guard 20, the detailed description thereof is not repeatedly recited hereinafter for the purpose of concise illustration of the present invention.

Figure 5:
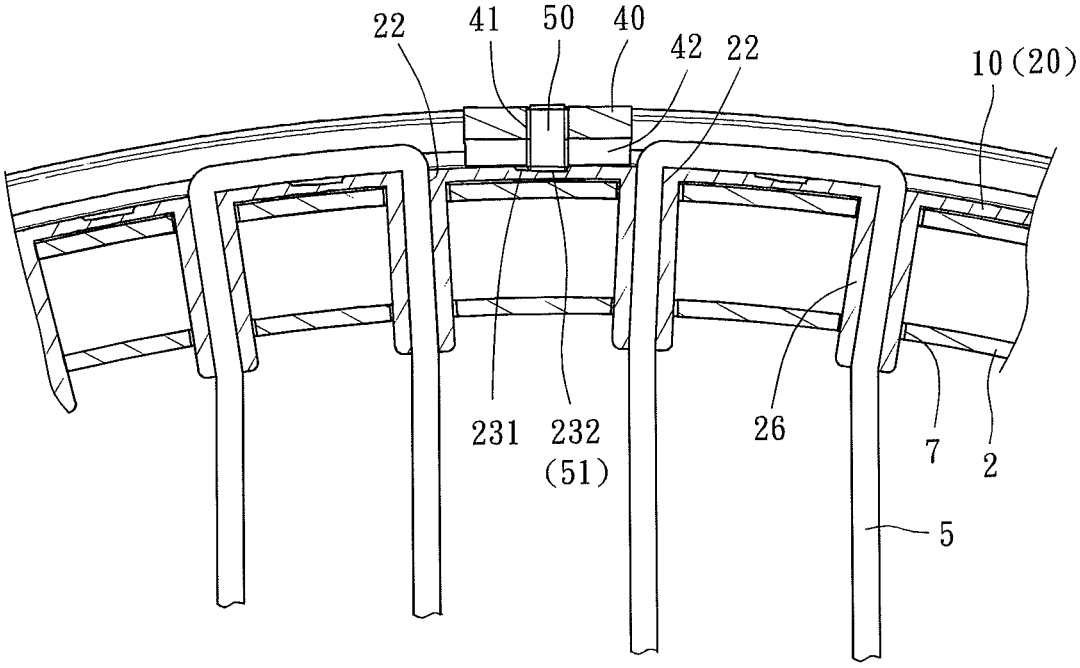
FIG. 5 is a longitudinally cross-sectional view of the frame and the weighting device of the preferred embodiment of the present invention, wherein the frame strip of the weighting device is realized as a protective guard and the string is inserted through the string holes.

The weight 40 is slidably engaged in the dovetail groove 21 or 31 of the protective guard 20 or the grommet strip 30, such that the weight 40 is moveable along the longitudinal direction of the protective guard 20 or the grommet strip 30. The weight 40 has a threaded though hole 41 penetrating through the top surface the bottom surface 401 thereof, and an string escape groove 42 formed on the bottom surface 401. The string escape groove 42 extends along the sliding direction of the weight 40 or the longitudinal direction of the frame strip 10 and faces the part of the string 5 that is received in the string receiving channel 6, such that the weight 40 won't be blocked by the string 5 when the weight 40 slides along the dovetail groove 21 or 31. Preferably, the weight 40 may have a length smaller than an interval between any two of the through holes 22, such that the weight 40 can be set at a place between two through holes 22, through which no strip 5 crosses, as shown in FIG. 5. This enables the user to set up the ball-hitting surface on the frame 2 by the string 5 even though the weight 40 has been installed on the frame 2 beforehand, and in this case, the weight 40 may include no such string escape groove 42. However, it is to be understood that the weight 40 may have a length greater than the interval of two said through holes 22.

The screw 50 may be, but not limited to, a flat head screw. The screw 50 is threadedly engaged with the threaded through hole 41 of the weight 40. When an urging end 51, namely the bottom end, of the screw 50 is tightly stopped against the bottom wall of the dovetail groove 21 or 31, the weight 40 is prohibited from movement, such that the weight 40 can be positioned at a desired position on the frame strip 10. To achieve a better positioning effect, the urging end 51 of the screw 50 can be stopped at one of the positioning recesses 23. Because the target positioning recess 23 is not visually available to the user's eyes when the screw 50 is being tightened, the positioning recess 23 is configured having the beveled guide surface 231 for guiding the screw 50 to move into the main positioning surface 232. Specifically speaking, when the urging end 51 of the screw 50 contacts the beveled guide surface 231, the beveled guide surface 231 will exerts a reaction force on the screw 50 in a direction towards the main positioning surface 232, resulting in that when the screw 50 is gradually tightened up, the screw 50 and the weight 40 will gradually move towards the main positioning surface 232 until the urging end 51 of the screw 50 is aligned with the main positioning surface 232 and the shank of the screw 50 is stopped against a lateral wall of the positioning recess 23, thereby achieving a precise and stable positioning effect. However, it will be appreciated that the bottom surface of the positioning recess 23 may be a flat surface rather than be divided into the beveled guide surface 231 and the main positioning surface 232. If it is this case, the urging position of the screw 50 can still be restricted in the range of the positioning recess 23, achieving a certain positioning effect.

The frame strip, i.e. the protective guard and grommet strip, of the present invention do not have to equipped with threaded tubes as the prior art does, so that it doesn't need to be tapped with a series of threaded holes. In addition, the weight can be easily made. Therefore, the weighting device of the present invention has a simpler manufacturing process than prior art. Further, the weight can be slidably moved along the dovetail groove to a desired position, such that position of the weight can be conveniently adjusted by the user. Furthermore, the present invention uses the screw to urge against the bottom wall of the dovetail groove so as to keep the weight in position firmly. By this way, the weight can be actuated by the screw to be raised away from the bottom wall of the dovetail groove and then tightly abut against the dovetail groove, thereby providing a friction force sufficient to firmly hold the weight in position so as to positively meet the user's need of adjusting the balance of the racket.

In a possible embodiment of the present invention, the outer circumference of the frame may be mounted with a single frame strip only, and the amount of the weight and screw may vary subject to the need of the user and/or manufacturer. In addition, the through holes and the positioning recesses of the frame strip may be randomly arranged on the bottom wall of the dovetail groove rather than alternately arranged. Further, the positioning recesses may be eliminated. In this case, the urging end of the screw is directly stopped at the bottom wall of the dovetail groove, achieving the same effect of poisoning the weight. All such modifications as would be obvious to one skilled in the art are intended to be included within the scope of the following claims.

What is claimed is:

1. A weighting device for use with a racket having a frame provided with a plurality of string holes, the weighting device comprising:

a frame strip for being mounted on an outer circumference of the frame of the racket, the frame strip having a dovetail groove extending along a longitudinal direction of the frame strip, and a plurality of through holes provided at a bottom wall of the dovetail groove for being aligned with the string holes of the frame of the racket respectively;

a weight provided with a threaded through hole and slidably engaged in the dovetail groove of the frame strip; and a screw threadedly engaged with the threaded through hole of the weight and having an end stoppable at the bottom wall of the dovetail groove of the frame strip for holding the weight stationarily.

2. The weighting device of claim 1, wherein the frame strip is provided at the bottom wall of the dovetail groove with at least one positioning recess; the end of the screw is optionally stopped at the positioning recess.

3. The weighting device of claim 2, wherein the frame strip comprises a plurality of said positioning recesses; the through holes and the positioning recesses of the frame strip are arranged in an alternate manner.

4. The weighting device of claim 2, wherein the positioning recess of the frame strip includes a main positioning surface and a beveled guide surface connected with a side of the main positioning surface; the side of the main positioning surface is located at the longitudinal direction of the frame strip.

5. The weighting device of claim 1, wherein the weight has a length smaller than an interval between two said through holes of the frame strip.

6. The weighting device of claim 1, wherein the weight has a bottom surface facing the bottom wall of the dovetail groove, and a string escape groove formed on the bottom surface and extending along the longitudinal direction of the frame strip.

7. The weighting device of claim 1, wherein the frame strip is provided at each of two lateral sides thereof with a wing for covering the outer circumference of the frame of the racket.

8. The weight device of claim 1, wherein the frame strip further comprises a plurality of tubular inserts communicated with the through holes of the frame strip respectively for being inserted into the string holes of the frame of the racket.

9. The weight device of claim 1, wherein the frame strip has at least a part for being received in a string receiving channel provided on the outer circumference of the frame of the racket; wherein the string holes of the frame of the racket are arranged in the string receiving channel.

10. A racket comprising:

a handle;

a frame having a plurality of string holes;

a bridge connected between the handle and the frame; and a weighting device comprising:

a frame strip mounted on an outer circumference of the frame and having a dovetail groove extending along a longitudinal direction of the frame strip, and a plurality of through holes provided at a bottom wall of the dovetail groove and each aligned with one of the string holes of the frame;

a weight provided with a threaded through hole and slidably engaged in the dovetail groove of the frame strip; and a screw threadedly engaged with the threaded through hole of the weight and having an end stoppable at the bottom wall of the dovetail groove of the frame strip for holding the weight stationarily.

11. The racket of claim 10, wherein the frame strip is provided at the bottom wall of the dovetail groove with at least one positioning recess; the end of the screw is optionally stopped at the positioning recess.

12. The racket of claim 11, wherein the frame strip comprises a plurality of said positioning recesses; the through holes and the positioning recesses of the frame strip are alternately arranged in an alternate manner.

13. The racket of claim 11, wherein the positioning recess of the frame strip includes a main positioning surface and a beveled guide surface connected with a side of the main positioning surface; the side of the main positioning surface is located at the longitudinal direction of the frame strip.

14. The racket of claim 10, wherein the weight has a length smaller than an interval between two said through holes of the frame strip.

15. The racket of claim 10, wherein the weight has a bottom surface facing the bottom wall of the dovetail groove, and a string escape groove formed on the bottom surface and extending along the longitudinal direction of the frame strip.

16. The racket of claim 10, wherein the frame strip is provided at each of two lateral sides thereof with a wing that covers a part of the outer circumference of the frame.

17. The racket of claim 10, wherein the frame strip further comprises a plurality of tubular inserts each communicated with one of the through holes of the frame strip and inserted into one of the string holes of the frame.

18. The racket of claim 10, wherein the frame is provided at the outer circumference thereof with a string receiving channel in which the string holes are arranged and at least a part of the frame strip is received.

* * * * *